US006817578B1

(12) United States Patent
Garcia et al.

(10) Patent No.: US 6,817,578 B1
(45) Date of Patent: Nov. 16, 2004

(54) ENHANCED AERIAL DELIVERY SYSTEM (EADS) PLATFORM

(75) Inventors: Anibal J. Garcia, Chino, CA (US); James S. Wells, Fountain Valley, CA (US); Myles A. Rohrlick, San Diego, CA (US); John B. Simmons, Corona, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/425,147

(22) Filed: Apr. 28, 2003

(51) Int. Cl.[7] ..... B64D 9/00

(52) U.S. Cl. ..... 244/137.1; 244/118.1; 410/77

(58) Field of Search ..... 244/137.1, 118.1; 410/92, 107, 34, 111, 79, 94, 121; 414/529, 531, 535, 536, 532; 193/35 R; 248/346.02, 346.5

(56) References Cited

U.S. PATENT DOCUMENTS

| | | | | | |
|---|---|---|---|---|---|
| 2,858,774 | A | * | 11/1958 | Dallas | 410/67 |
| 3,429,536 | A | * | 2/1969 | Weingarten et al. | 410/77 |
| 3,741,504 | A | | 6/1973 | Alberti et al. | |
| 3,972,439 | A | * | 8/1976 | DiMartino | 24/287 |
| 4,241,890 | A | | 12/1980 | Pearson | |
| 4,284,013 | A | | 8/1981 | Davidson | |
| 4,629,379 | A | | 12/1986 | Harris et al. | |
| 4,807,735 | A | * | 2/1989 | Huber | 193/35 B |
| 4,915,567 | A | | 4/1990 | Ellingsen | |
| 4,966,310 | A | * | 10/1990 | Hawkins | 222/105 |
| 5,454,673 | A | * | 10/1995 | DiMartino | 410/79 |
| 5,774,948 | A | * | 7/1998 | Petschke et al. | 24/265 CD |
| 5,799,585 | A | * | 9/1998 | Brennan et al. | 108/53.1 |
| 5,865,579 | A | | 2/1999 | Thomas | |
| D408,267 | S | * | 4/1999 | Egigian et al. | D8/354 |
| 5,927,650 | A | * | 7/1999 | Huber | 244/118.1 |
| 5,961,262 | A | * | 10/1999 | Weber | 410/94 |
| 6,138,975 | A | * | 10/2000 | McDaid | 248/499 |
| 6,186,468 | B1 | * | 2/2001 | Schlegel | 248/678 |
| 6,241,439 | B1 | * | 6/2001 | Weber | 410/94 |
| 6,427,947 | B1 | | 8/2002 | Rohrlick et al. | |

FOREIGN PATENT DOCUMENTS

| | | | | |
|---|---|---|---|---|
| FR | 1358996 | * | 3/1964 | 244/137.1 |

* cited by examiner

*Primary Examiner*—Tien Dinh
(74) *Attorney, Agent, or Firm*—Harness Dickey & Pierce P.L.C.

(57) ABSTRACT

A single transportation platform system capable of interfacing with standardized ISO containers, PLS truck-and-trailer systems, HSVs Fast Sealift Ships, and cargo aircraft's 463L rail and pallet locking systems. The system can be handled by a LHS equipped vehicle as a joined platform or separated into individual pallets and handled like a 463L pallet. The platform provides a pallet system that eliminates the need for a married pallet system to be used in the process of loading and supporting loads normally transported on standard CROPs when being transported on a cargo aircraft. The platform can be positioned directly on the roller assembly of a loading ramp of a cargo aircraft, such as a C-17 by a LHS equipped vehicle, so as to facilitate loading and unloading from the aircraft without the need for large cranes or K-loaders. The platform also permits combat offloads to be performed.

29 Claims, 13 Drawing Sheets

ENHANCED AERIAL DELIVERY SYSTEM (EADS) PLATFORM

FIELD OF THE INVENTION

The present invention relates to a platform system capable of interfacing with a wide variety of material handling equipment and transport aircraft to replace 463L logistics pallets, airdrop platforms, and Container Roll in/Out Pallets.

BACKGROUND OF THE INVENTION

The United States Department of Defense and, in particular, the United States Army have recently identified a need in the handling and transporting of logistics from location to location. Specifically, the United States Army has indicated that it is in need of a system that would be capable of supporting logistics and/or other materials that can be easily and convenient transported via air, sea, rail, and road without requiring extensive support equipment or modification of the transport vehicle. In other words, the United States Army is in need of a single cargo system that is capable of interfacing with existing material handling equipment and various transport aircraft cargo systems, which is capable of replacing existing 463L material handling system, airdrop platforms, and Container Roll In/Out Platforms (CROPs) such that logistics that have been packaged for one mode of transportation (i.e. air, sea, rail, or road) can be easily loaded for another mode of transportation without the need to repackage.

By way of background, the existing 463L material handling system generally employs pallets that are approximately 96"×108" in size and include a series of tongues extending horizontally about the periphery of the pallet. These tongues are sized to be received and retained within rails formed in aircraft cargo systems.

Often times, one type of cargo system must be packaged on another cargo system for it to be used in more than one mode of transportation. For example, in order for CROPs to be loaded onto military transport aircraft, such as the C-17 and the C-130, they must first be loaded on a series of 463L pallets. The CROPs include a complexly shaped underside having numerous support members therealong, which prevent rolling of the CROPs along the aircraft cargo roller system. Therefore, in order for CROPs, or for that matter any flatrack or ISO container, to be transported via aircraft, each CROP must be loaded onto three standard 463L pallets. To this end, these three 463L pallets are first coupled to each other in a "married" configuration. Next, a large crane is required to lift the CROP onto the "married" 463L pallets. The load must then be secured to the 463L pallets with restraint straps or chains. Finally, Material Handling Equipment, such as a K-loader, is used to transport the entire assembly, including the "married" 463L pallets and CROP, and load it onto the loading ramp of the aircraft where it is then moved into the cargo area. This procedure is necessary because the CROP cannot be rolled directly on the roller assemblies of the aircraft because of their complexly shaped lower surface.

In order for CROPs, flatracks, or ISO containers to be loaded onto the "married" 463L pallets, heavy equipment must be available at the loading site to lift such heavy cargo onto the 463L pallets. Traditionally, a crane and a K-loader are airlifted to the areas where the aircraft is to be loaded and unloaded, which increases the complexity of the operation.

The use of "married" 463L pallets further limits how the cargo is to be unloaded. That is, the "married" 463L pallets are unable to withstand the forces generated during a "combat offload," where the cargo is permitted to simply roll off the loading ramp of the aircraft while the aircraft is moving along a runway, taxiway, or parking ramp immediately after landing. Since combat offloads are prohibited when employing a married pallet system, the delivery of CROPs is limited to only those locations where a large crane and K-loader are available. This eliminates the possibility of off-loading cargo at generally small, austere airfields where such equipment is not available. Therefore, material handling equipment such as the crane and the K-loader must be flown ahead of time on a separate aircraft to the location where the aircraft carrying the CROPs is to be offloaded. On occasion, as many as three flights may be needed to deliver one CROP to an austere airfield (i.e., one flight to transport a K-loader, one flight to transport a crane, and one flight to transport the CROP). As can be readily appreciated, this adversely effects the deployment of materials and equipment.

Additionally, conventional pallet systems limit the carrying capacity of the C-17 in that they permit only three CROPs to be carried down the center of the aircraft on the 463L interface pallets, which are secured in the 108" air drop rail system (ADS).

Accordingly, there exists a need in the relevant art to provide a platform system that eliminates the need for a married pallet system to be used in the process of loading and supporting a CROP being transported on a cargo aircraft. Furthermore, there exists a need in the relevant art to provide a single platform system that can be positioned on the roller assembly of a loading ramp of a cargo aircraft, such as a C-17, that also is compatible with PLS systems, and aircraft pallets systems such that the entire assembly can be loaded onto or unloaded from the aircraft without the need for a large crane (i.e. combat offloads). Currently, 463L logistics pallets, airdrop platform, and CROPs are three distinct and different logistics systems. There exists a need to combine these logistics systems into a single system. There exists a need in the relevant art to provide a platform system that overcomes the disadvantages of the prior art.

SUMMARY OF THE INVENTION

According to the principles of the present invention, a single modular transportation platform is provided having an advantageous construction. The platform is capable of interfacing with standardized ISO containers, PLS truck-and-trailer systems, and cargo aircraft's 463L rail and pallet locking systems. The platform provides a system that eliminates the need for a married pallet system to be used in the process of loading and supporting CROP type cargo loads being transported on a cargo aircraft. The platform can be positioned on the roller assembly of a loading ramp of a cargo aircraft, such as a C-17, so as to facilitate loading and unloading from the aircraft by a PLS Vehicle without the need for large cranes. The platform also permits combat offloads to be performed.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
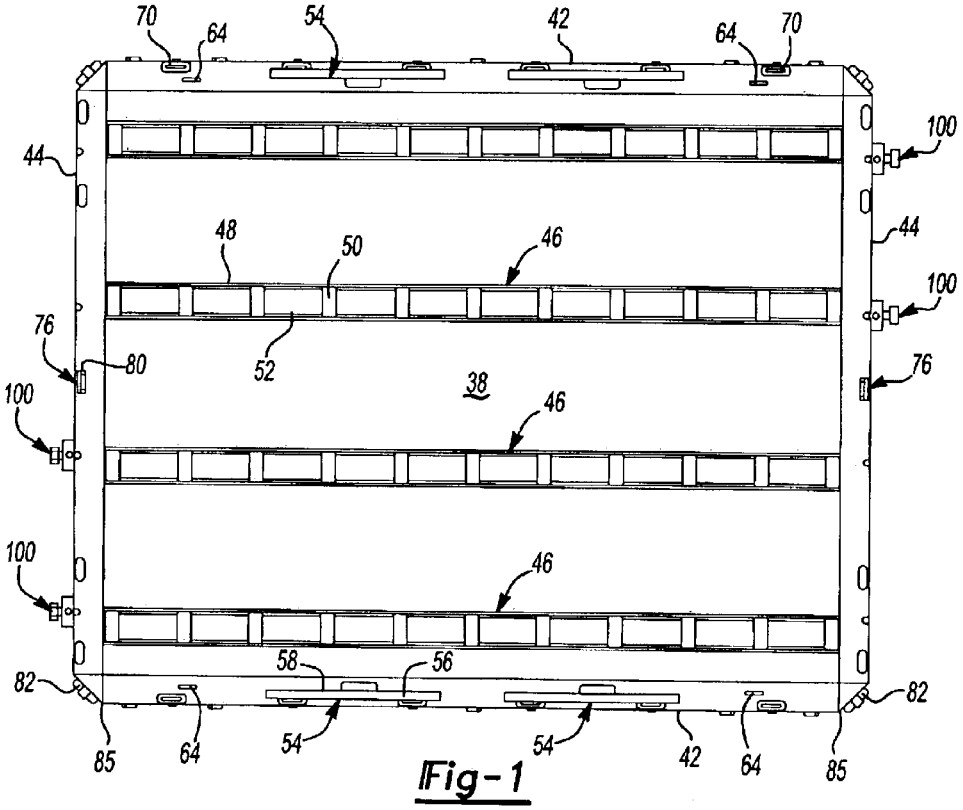
FIG. 1 is a top view illustrating an EADS platform according to the principles of the present invention.

The following description of the preferred embodiment is merely exemplary in nature and is in no way intended to limit the invention, its application, or uses.

Referring to the figures, an Enhanced Air Delivery System platform, generally referred to as EADS platform 10, is illustrated according to the principles of the present invention. As best seen in FIGS. 15–19, EADS platform 10 is illustrated for use in concert with an aircraft 12 and an optional loading vehicle 14. Aircraft 12 is preferably a cargo type aircraft, such as a Boeing C-17, having a fuselage 16 and a cargo compartment 18 located within fuselage 16. Cargo compartment 18 includes a deck 20 extending generally throughout cargo compartment 18 and an actuatable cargo ramp system 22. Cargo ramp system 22 is positionable in a fully closed position, a fully opened position, and various intermediate positions between the fully closed position and the fully opened position. In this particular embodiment, cargo ramp system 22 includes an upper cargo door 24 and a lower cargo door 26. In the fully closed position, upper cargo door 24 and lower cargo door 26 are sealed and locked against fuselage 16 of aircraft 12 to form a generally smooth aerodynamic surface. In the fully opened position, upper cargo door 24 pivots about an upper hinge member (not shown) into a generally horizontal position within fuselage 16. Lower cargo door 26 pivots about a lower hinge member 30 into a generally extended position.

Figure 16:
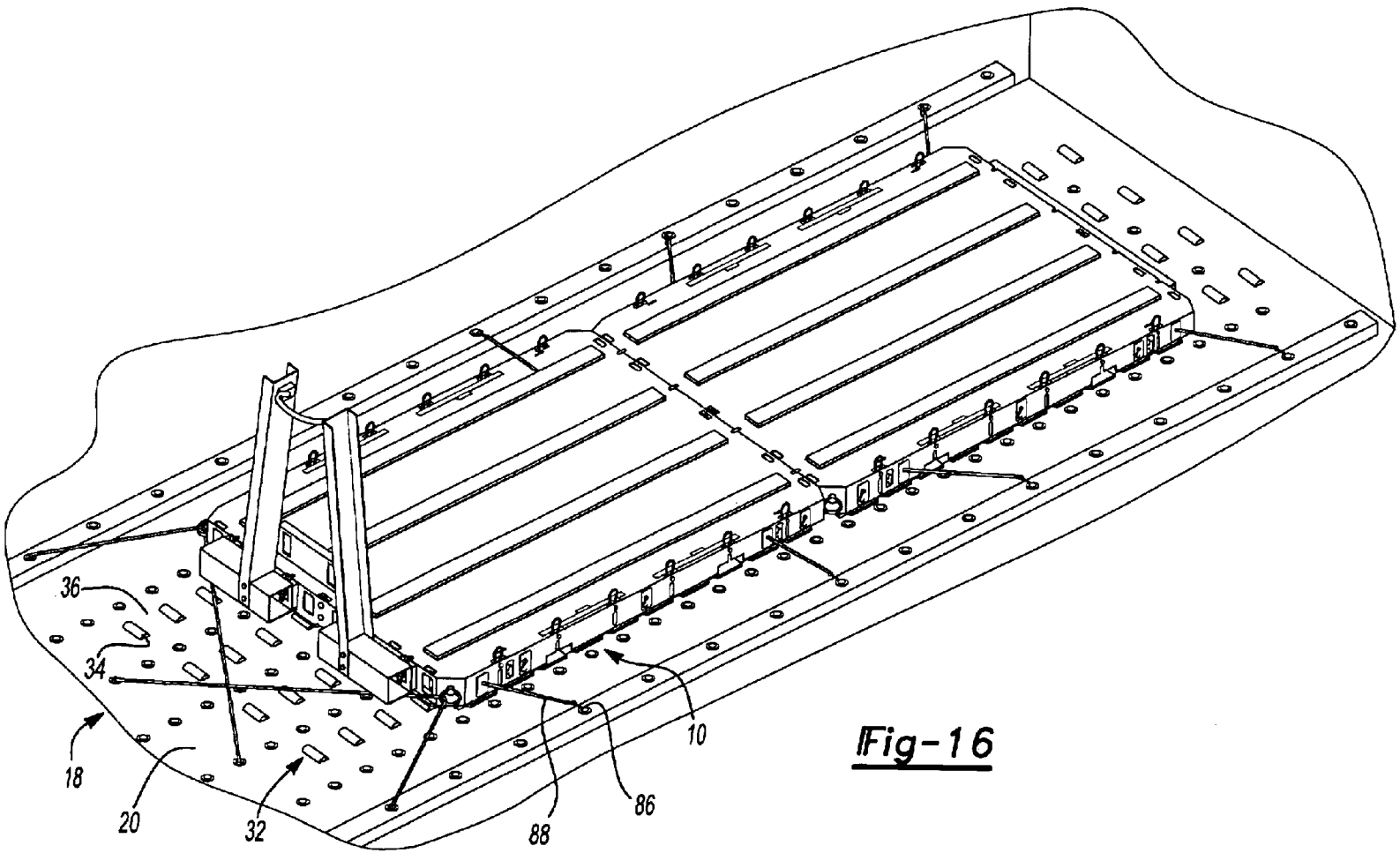
FIG. 16 is a perspective view illustrating the EADS platform according to the principles of the present invention being tied down in a cargo aircraft.

As best seen in FIG. 16, aircraft 12 further includes a conventional cargo roller system 32 disposed within cargo compartment 18. Cargo roller system 32 includes a plurality of rollers 34 pivotally journalled to a track (not shown). The track is typically coupled to deck 20 of aircraft 12 in a longitudinal direction to support cargo pallets thereon. Conventional cargo pallets typically are rolled over the plurality of rollers 34 and into position for transport. However, it should be appreciate that the specific cargo roller system employed in aircraft 12 is not particularly important and, as will be discussed, EADS platform 10 can be used with many conventional roller systems.

EADS platform 10 is designed to maintain all of the existing capabilities of conventional CROPs, which includes interfacing with existing containers and vehicles. However, EADS platform 10 further includes the ability to interface with all transport aircraft roller systems, such as but not limited to the C-5, C-17, C-130, and C-141, and C-17 type rail systems. EADS platform 10 may be employed air drop deliveries as an individual pallet or linked as a large platform. Whether used individually or linked together, EADS platform 10 is retrievable from the drop zone using any load handling system (LHS) equipped vehicle, thereby eliminating the need to manually unload air dropped platforms while at the drop zone. EADS platform 10 enables the seamless interface between all modes of cargo transportation, including but not limited to the Army Palletized Load System (PLS), the HEMMT Load Handling System (LHS), the ISO container system, transport aircraft, and the Fast Sealift Theater Support High Speed Vessel (HSV) system.

Turning now to FIGS. 1–4, EADS platform 10 will now be described in detail. EADS platform 10 preferably includes an upper surface 38, a lower surface 40, a pair of longitudinal sides 42, a pair of ends 44, a plurality of flip-over roller trays 46, a plurality of retractable pallet rails 54, a plurality of retractable pallet locks 64, a plurality of retractable tie down rings 70, a plurality of retractable pallet stops 76, a plurality of heavy lift rings 82, a plurality of retractable restraints 84, a cargo system compatible edge structure 92, a plurality of interface clamp systems 100, a removable A-arm assembly 120, and a removable adjustable wheel assembly 130.

Figure 2:
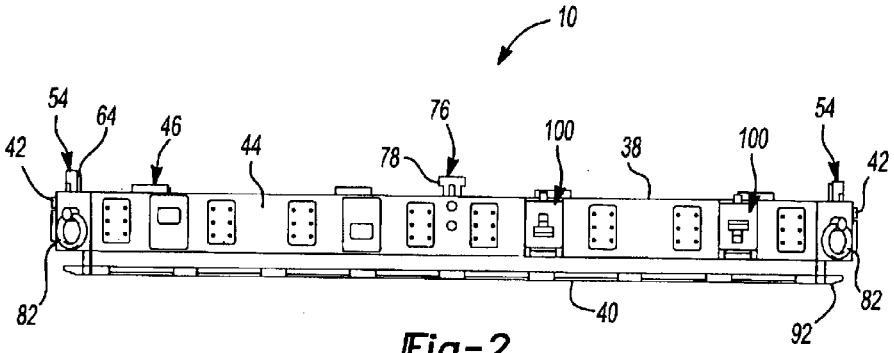
FIG. 2 is an end view illustrating the EADS platform according to the principles of the present invention.
Figure 3:
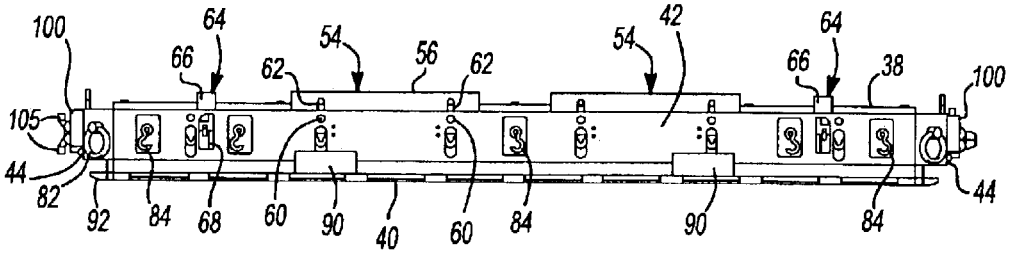
FIG. 3 is a side view illustrating the EADS platform according to the principles of the present invention.
Figure 4:
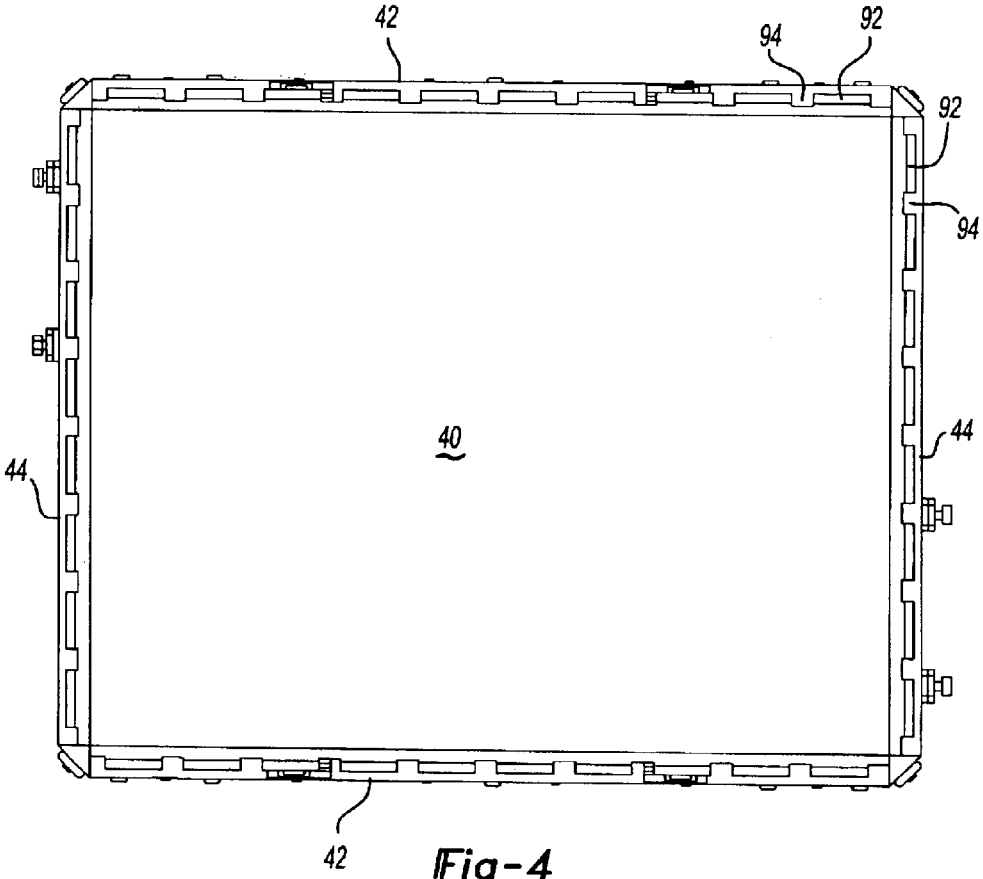
FIG. 4 is a bottom view illustrating the EADS platform according to the principles of the present invention.

As can be appreciated from the figures, upper surface 38 is generally planar in construction, but for those features that will be described in detail below. Lower surface 40 is preferably planar, with no extending features, so as to permit EADS platform 10 to roll freely and smoothly over conventional cargo roller system 32 of aircraft 12. As best seen in FIGS. 2–4, lower surface 40 includes cargo system compatible edge structure 92 extending around the periphery thereof. Preferably, edge structure 92 is approximately 88" wide (as seen in FIG. 2) and 108" long (as seen in FIG. 3) so as to be immediately compatible with cargo rail systems used in transport vehicles, such as the C-17 and C-130 aircraft, Theater Support High Speed Vessels (HSVs), and K-loaders. As best seen in FIG. 4, edge structure 92 further includes a plurality of notches 94 formed therein so as to lockingly engage pallet locks currently available on transport aircraft.

The pair of longitudinal sides 42 and ends 44 of EADS platform 10 extend vertically between upper surface 38 and lower surface 40, thereby defining an individual robust pallet or platform member. However, it should be understood that EADS platform 10 may of any shape that is conducive to supporting and transporting cargo.

EADS platform 10 is preferably made of aluminum and is therefore sufficiently light to enable it to be lifted and transported by light cargo handling equipment. However, it should be appreciated that EADS platform 10 may be made of any material that provides the necessary physical characteristics to achieve the preferred loading capability, corrosion resistance, durability, etc.

As best seen in FIGS. 1 and 5–7, EADS platform 10 includes the plurality of flip-over roller trays 46 generally extending longitudinally along tracks 48 formed in upper surface 38. In the present embodiment, the plurality of roller trays 46 each includes a plurality of rollers 50 rotatably coupled within a tray 52. The plurality of roller trays 46 are particularly adapted for guiding and supporting cargo into position on EADS platform 10. However, if cargo is to be loaded that will not benefit from a roller system, the plurality of roller trays 46 may be flipped over within tracks 48 formed in upper surface 38 to reveal a generally flat opposing side 49 (FIG. 8). The plurality of roller trays 46 are retained within tracks 48 via a frictional fit, snap fit, or other quick release system, thereby providing quick and convenient changes.

With particular reference to FIGS. 1–3 and 6, EADS platform 10 further includes the plurality of retractable pallet rails 54 formed about the periphery of upper surface 38 to aid in retaining cargo upon EADS platform 10 and preventing lateral movement thereof. In the present embodiment, the plurality of retractable pallet rails 54 are disposed generally adjacent longitudinal sides 42; however, it should be appreciated that the plurality of retractable pallet rails 54 may be disposed at any position on EADS platform 10. Each of the plurality of retractable pallet rails 54 includes a rail member 56 slidably disposed in a rail slot 58 formed vertically within EADS platform 10. Rail slot 58 preferably includes a pair of guide pins 60 disposed transversely through rail slot 58, which is sized to engages a pair of cam slots 62 formed in rail member 56 (see FIGS. 1, 3, and 6). The plurality of retractable pallet rails 54 each further includes a locking mechanism (not shown) to retain rail member 56 in either a raised or lowered position. This locking mechanism may include a detent, ball-detent, or clip mechanism or the like. It should be appreciated that EADS platform 10 may simply include a single, elongated pallet rail on opposing sides of EADS platform 10 or may eliminate this feature all together.

Referring now to FIGS. 1–3, EADS platform 10 includes the plurality of retractable pallet locks 64 disposed in strategic locations about upper surface 38. The plurality of retractable pallet locks 64 are strategically located to allow them to be raised into the notches on the edge of 463L pallets to provide restraint. Each of the plurality of retractable pallet locks 64 includes a lock member 66 slidably disposed in a lock slot 68 formed vertically within EADS platform 10. Lock slot 68 preferably includes a locking mechanism (not shown) to retain lock member 66 in either a raised or lowered position. This locking mechanism may include a detent, ball-detent, or clip mechanism or the like. It should be appreciated that EADS platform 10 may simply include a single, elongated pallet rail on opposing sides of EADS platform 10 or may eliminate this feature all together.

Figure 17:
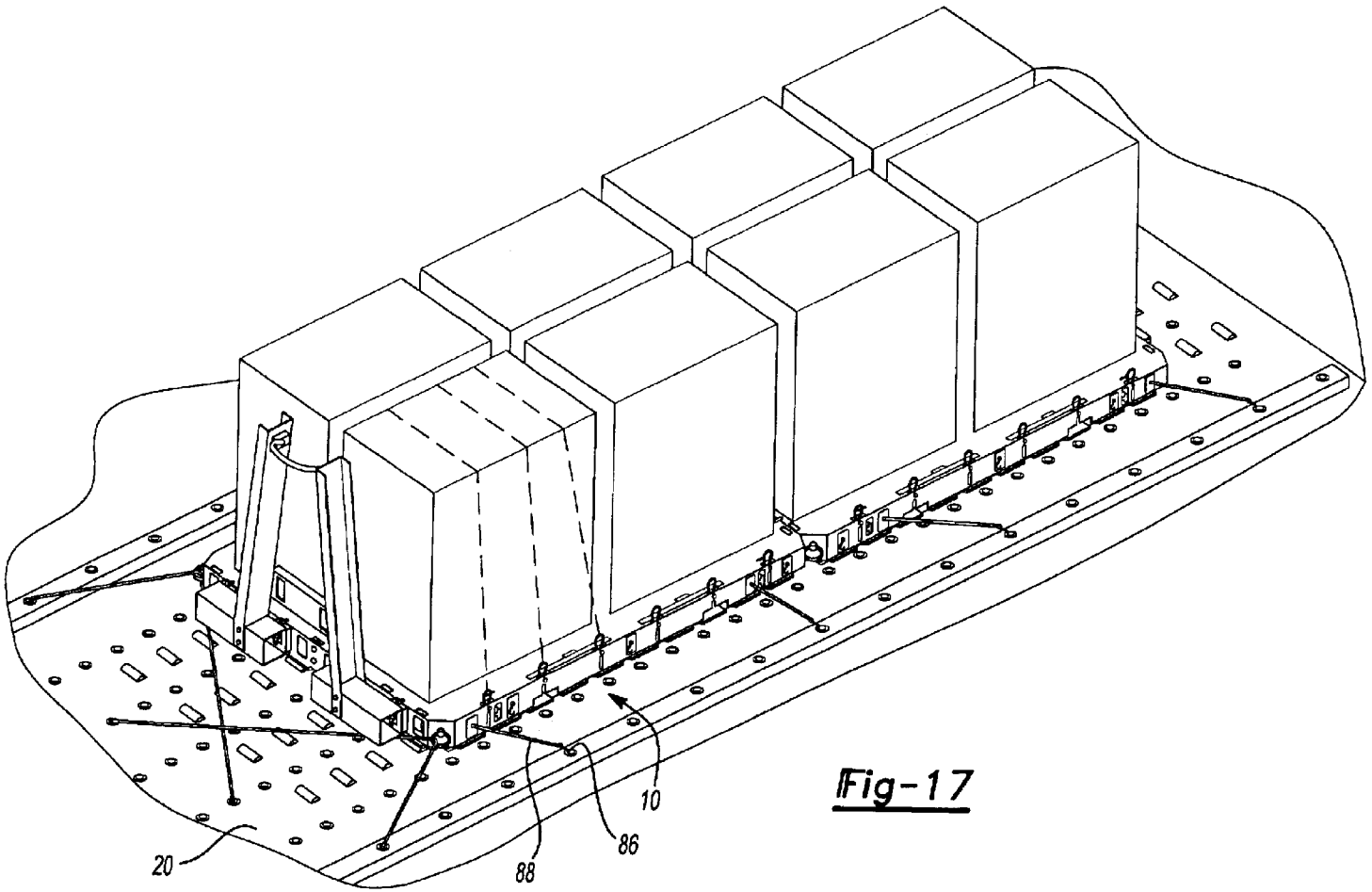
FIG. 17 is a perspective view illustrating the EADS platform according to the principles of the present invention being loaded and tied down in a cargo aircraft.
Figure 18:
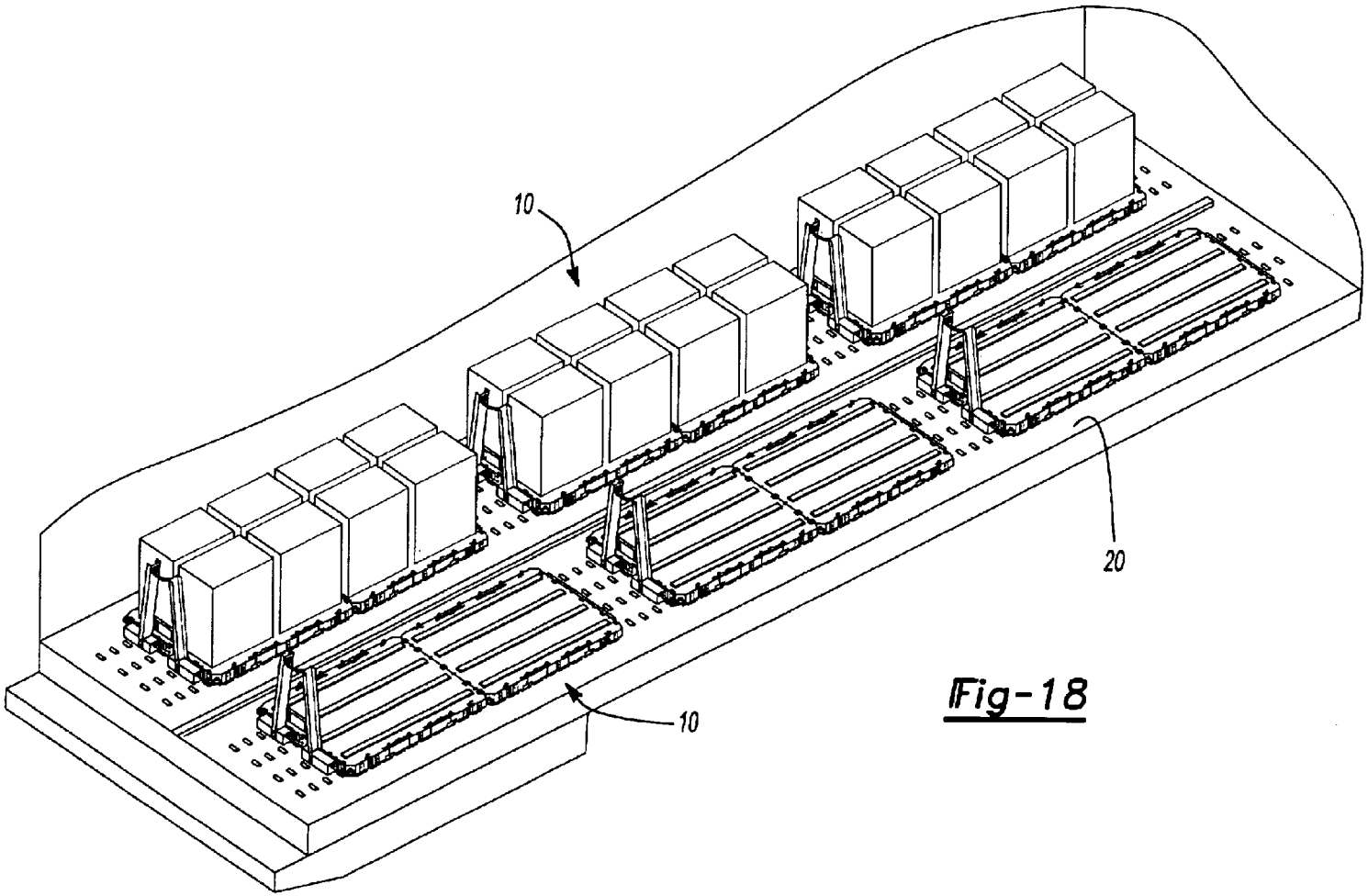
FIG. 18 is a perspective view illustrating a plurality of EADS platforms loaded in a cargo aircraft according to the principles of the present invention.
Figure 19:
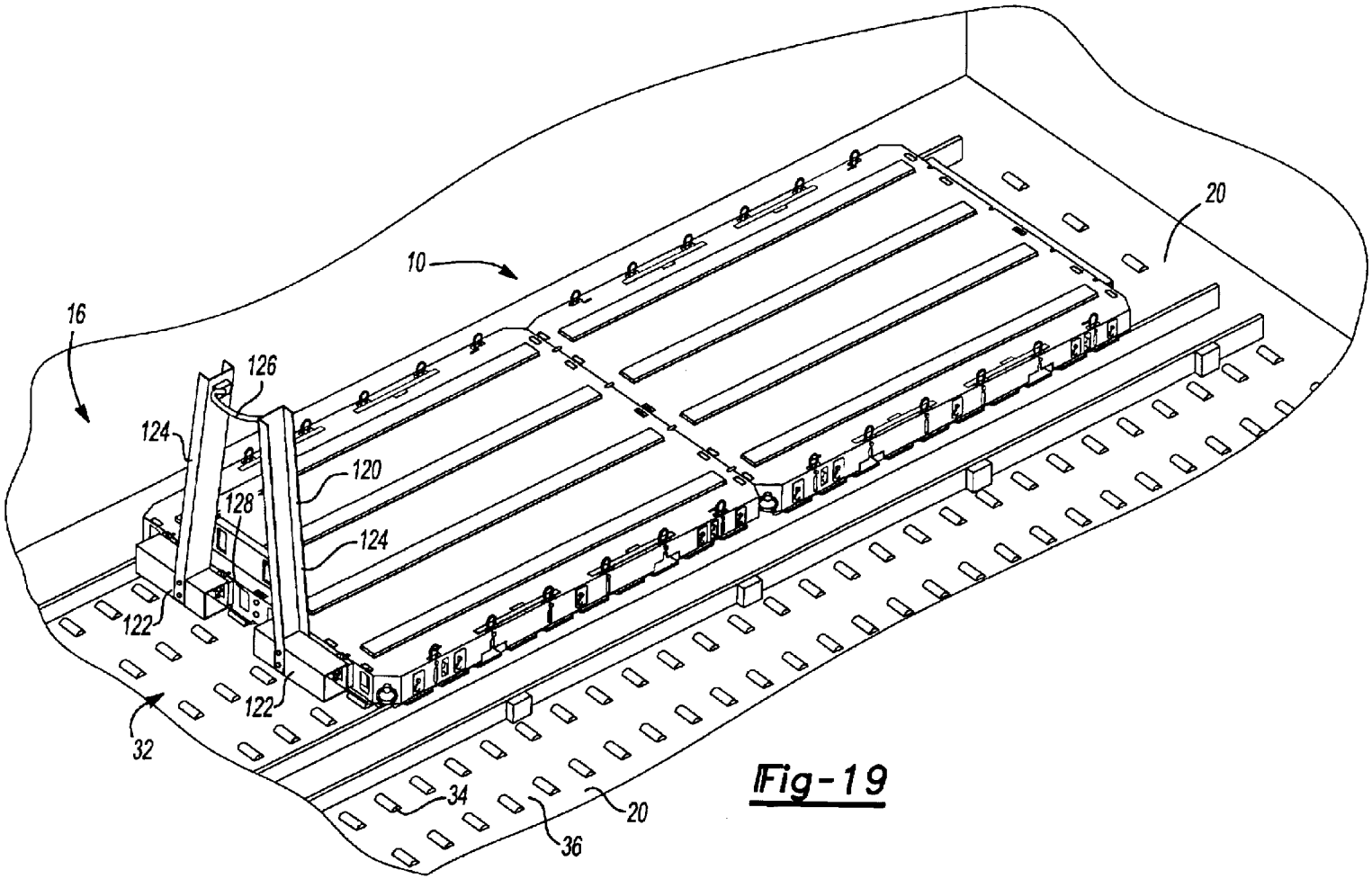
FIG. 19 is a perspective view illustrating the EADS platform according to the principles of the present invention locked in a 88" cargo system of a cargo aircraft, with portions illustrating a rail system and portions illustrating a notch system.

Referring now to FIGS. 1, 5–8, and 10, EADS platform 10 includes the plurality of retractable tie down rings 70 disposed in strategic locations about upper surface 38 to be used to tie down cargo loaded on EADS platform 10 (see FIG. 17). However, it should appreciated that the plurality of retractable tie down rings 70 may be disposed at any location on EADS platform 10 that facilitates convenient tie down of the cargo. Each of the plurality of retractable tie down rings 70 includes a tie down member 72 slidably disposed in a tie down slot 74 formed vertically within EADS platform 10. Tie down slot 74 preferably includes a locking mechanism (not shown) to retain tie down member 72 in either a raised or lowered position. This locking mechanism may include a detent, ball-detent, or clip mechanism or the like.

Referring to FIGS. 1, 2, and 8, EADS platform 10 additionally includes the pair of retractable pallet stops 76 formed at the periphery of upper surface 38 adjacent ends 44 to aid in retaining cargo upon EADS platform 10 and preventing fore/aft movement thereof. However, it should be appreciated that the plurality of retractable pallet stops 76 may be disposed at any location on EADS platform 10 that assisting in the loading of EADS platform 10. Each of the plurality of retractable pallet stops 76 includes a stop member 78 slidably disposed in a stop slot 80 formed vertically within EADS platform 10. Stop slot 80 preferably includes a locking mechanism (not shown) to retain stop member 78 in either a raised or lowered position. This locking mechanism may include a detent, ball-detent, or clip mechanism or the like.

As best seen in FIGS. 1–3, 5, and 6, EADS platform 10 further includes the plurality of heavy lift rings 82 preferably disposed at the corners of EADS platform 10. The plurality of heavy lift rings 82 are fixedly coupled to a corner section 85 vertically disposed between end 44 and longitudinal side 42 so as to permit the lifting of a loaded EADS platform 10 using a crane, helicopter, or similar machinery and/or tying down of EADS platform 10 within cargo compartment 18 (see FIG. 16 and 17).

Still referring to FIGS. 3, 5, 6, 16, and 17, EADS platform 10 includes a plurality of retractable restraints 84 preferably disposed along longitudinal sides 42. Each of the plurality of retractable restraints 84 includes a hook member 86 coupled to the end of a retractable tether line 88 (see FIGS. 16 and 17). The plurality of retractable restraints 84 may be used for any one of a number of applications, including tying down of primary or secondary cargo on EADS platform 10, and/or the tying down of EADS platform 10 within cargo compartment 18 (see FIGS. 16 and 17).

Figure 5:
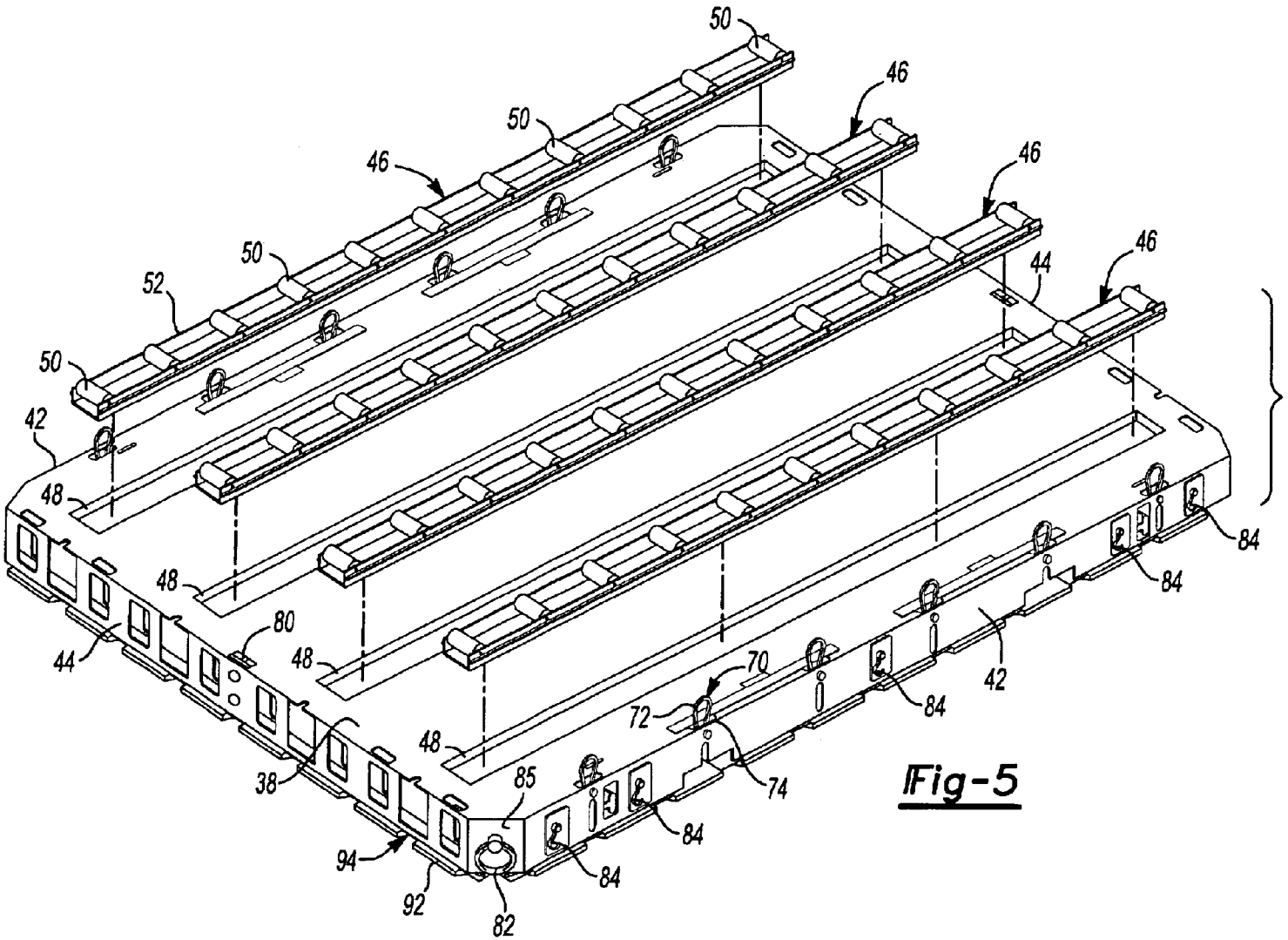
FIG. 5 is a perspective view illustrating removable roller trays and additional features according to the principles of the present invention.
Figure 6:
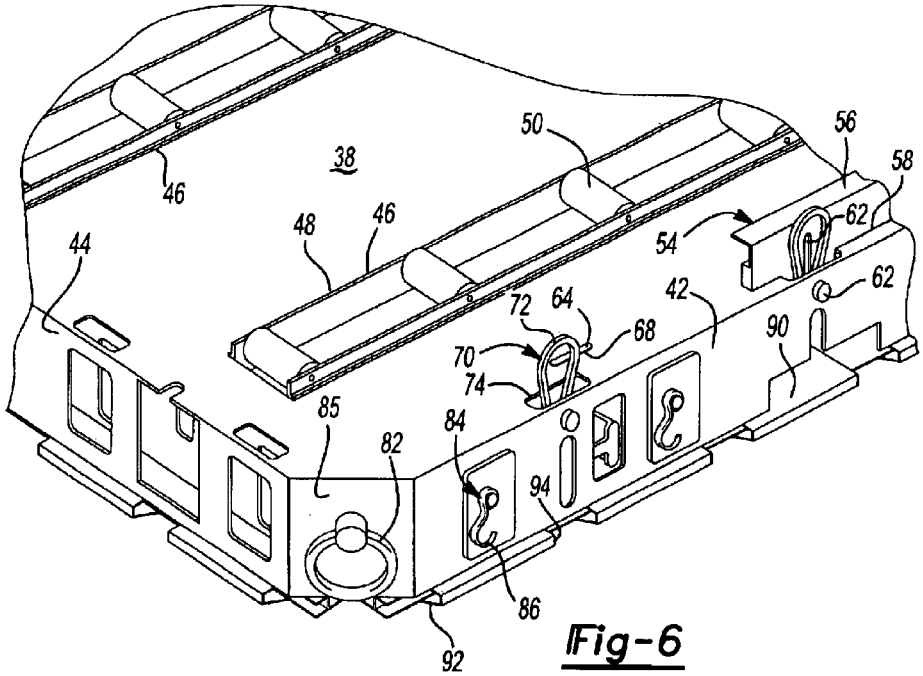
FIG. 6 is an enlarged perspective view illustrating a number of connections and handling features incorporated into the EADS platform according to the principles of the present invention.

Additionally, as seen in FIGS. 3, 5, and 6, EADS platform 10 preferably includes a pair of fork lift channels 90 extending through EADS platform 10 to permit EADS platform 10 and any cargo loaded thereon to be conveniently lifted with a conventional fork lift without the need to tear down the loaded cargo.

Figure 7:
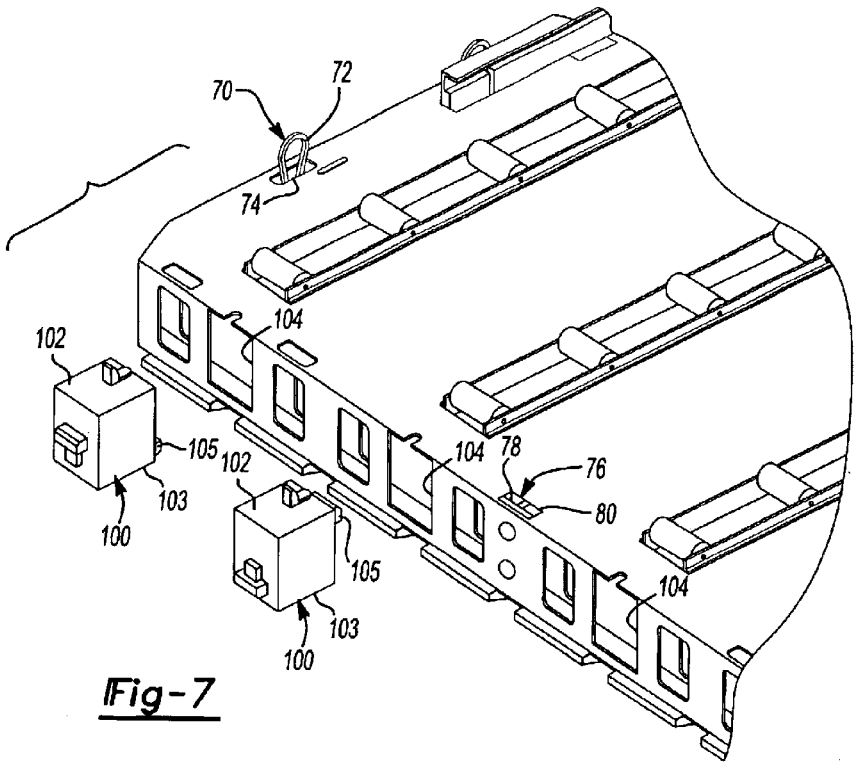
FIG. 7 is an enlarged perspective view illustrating the interface clamping system according to the principles of the present invention.
Figure 8:
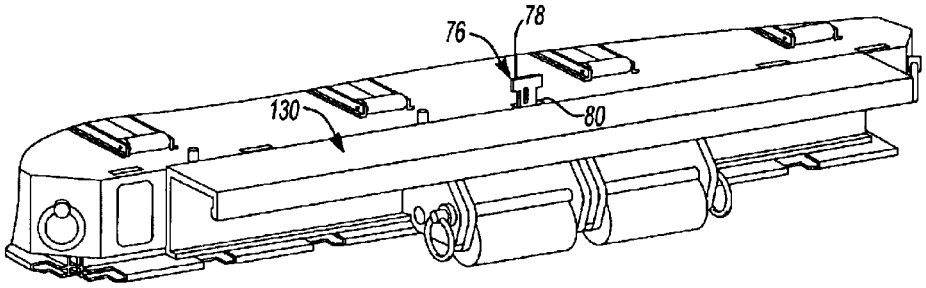
FIG. 8 is an enlarged perspective view illustrating the retractable pallet stops and adjustable wheel assembly according to the principles of the present invention.

Turning now to FIGS. 1–3, and 7, EADS platform 10 employs the plurality of interface clamp systems 100 to engage and retain multiple EADS platforms 10 together along a mated edge or couple attachments to the remaining unmated edges thereof. According to the preferred embodiment, four interface clamp systems 100 are available for use along each of the pair of ends 44 of EADS platform 10. As best seen in FIG. 7, each of the plurality of interface clamp systems 100 includes an interface clamp 102 coupled to end 44 of EADS platform 10 and an opposing interface clamp receptacle 104 formed on an adjacent EADS platform 10' for coupling with interface clamp 102. More particularly, interface clamp 102 includes a symmetrical housing body 103 which fits into opposing interface clamp receptacles 104 and is centered on the interface plane, two clamping jaws 105 which protrude from opposing sides of housing body 103, and two drive screws which are positioned symmetrically across the interface plane. Clamping jaws 105 rotate to engage an internal rib in interface clamp receptacle 104, and draw a pair of EADS platforms 10 together in a secure slack-free connection. Two configurations of interface clamp 102 are used. The first configuration contains clamping jaws, which rotate upward to engage. The second configuration contains clamping jaws, which rotate downward to engage. A pair of each configuration is used at the interface plane to carry both upward and downward bending moments across the interface of two mated EADS platforms 10. The drive screws may be operated directly with a hand tool, or operated remotely by crank, wheel, or ratchet attached to a linkage for improved access to operate the interface clamps 102 with loaded EADS platforms 10. The interface clamp 102 is commercially available as a slack-free connector for ISO containers. The interchangeable interface clamps 102 may be permanently fixed to one EADS platform 10 in a symmetric pattern that preserves the interchangeability of all EADS platforms 10. An alternative design would make use of commercially available slack-free ISO connectors that bolt to an EADS platform 10 on one side, and engage a clamping jaw into the interface clamp receptacle 104 on the opposing EADS platform 10 on the other side. This design may be used to attach A-arm assembly 120 or wheel assembly 130.

Figure 9:
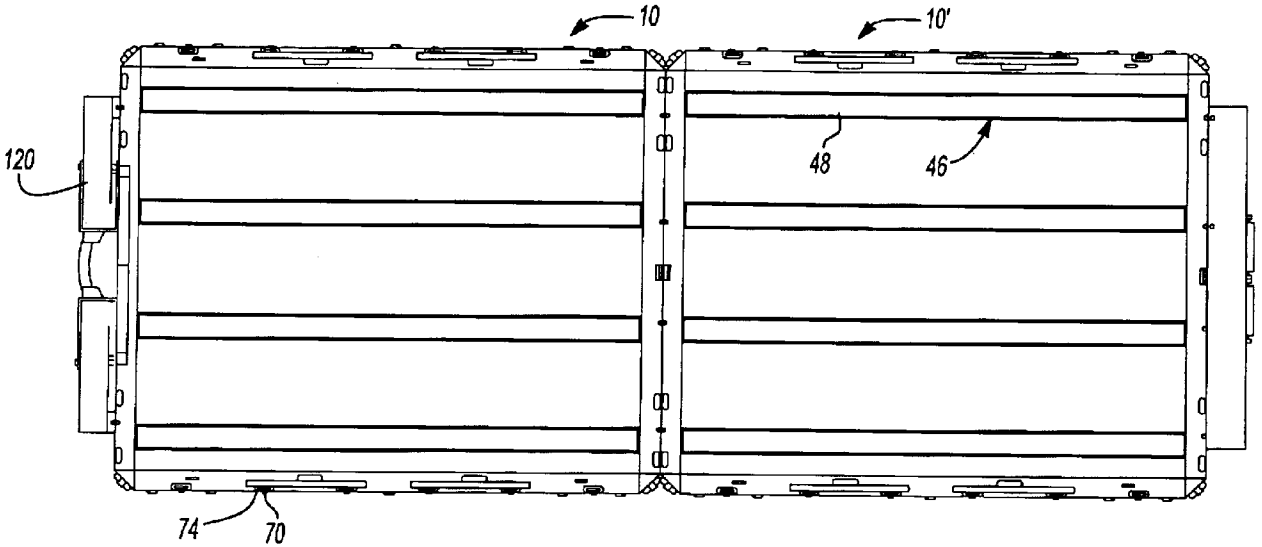
FIG. 9 is a top view illustrating a pair of EADS platforms linked together to form an EADS platform (CROP replacement) having a removable A-arm and a removable, adjustable wheel assembly according to the principles of the present invention.
Figure 10:
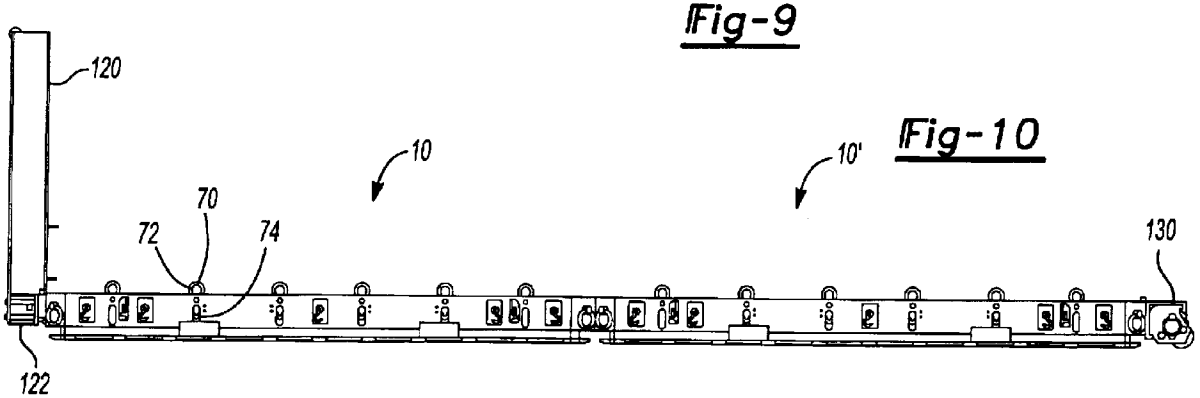
FIG. 10 is a side view illustrating the pair of EADS platforms linked together forming an EADS platform according to the principles of the present invention.

As seen in FIGS. 9 and 10, employing the plurality of interface clamp systems 100, a first EADS platform 10 may be mated with a second EADS platform 10' to define a single, substantially co-planar pallet. The plurality of interface clamp systems 100 aid in drawing EADS platform 10 and 10' together to form a rigid platform transportable by LHS equipped vehicles.

However, as it should be understood, interface clamp systems 100 enable EADS platform 10 and 10' to be easily coupled, but equally importantly, to be easily separated to facilitate the handling of EADS platform 10 in smaller, lighter segments.

Figure 11:
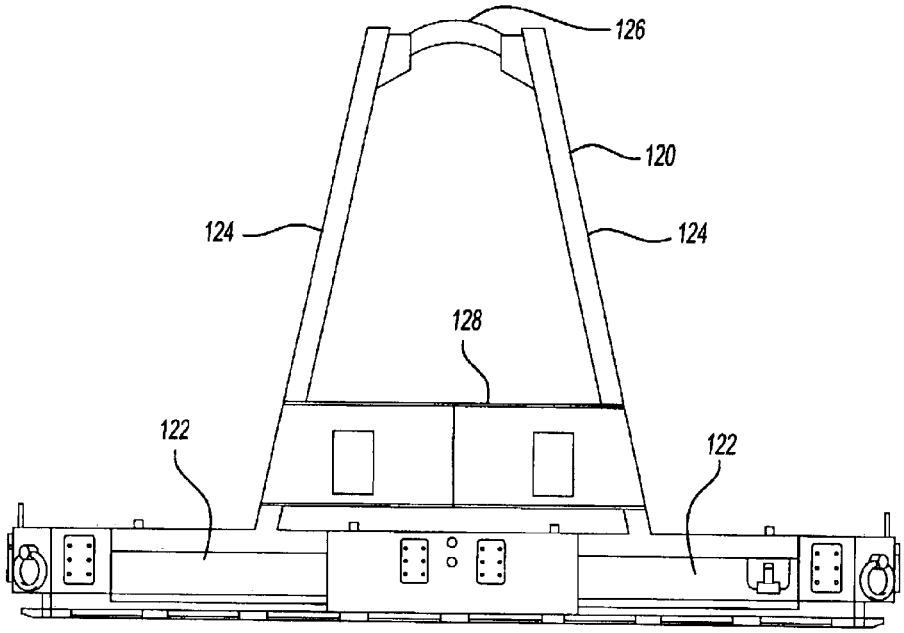
FIG. 11 is an end view illustrating the EADS platform according to the principles of the present invention.

Referring now to FIGS. 9–11 and 15–19, EADS platform 10 includes a removable A-arm assembly 120. As best seen in FIG. 11, A-arm assembly 120 generally includes a main support member 122, a pair of support arms 124 fixedly coupled and upwardly-extending from main support member 122, a lateral cross member or bail bar 126 generally extending horizontally between the pair of support arms 124, and an optional reinforcement member 128 similarly extending between the pair of support arms 124. This arrangement generally defines an A-shaped configuration. However, it should be appreciated that the present invention should not be regarded as being limited to the present configuration as any arrangement that facilitates interface with the load handling system (LHS) of a transporting vehicle or Palletized Load System (PLS) equipped truck is to be regarded as within the scope of the present invention.

However, according to the presently preferred embodiment, main support member 122 is preferably a generally square-shaped tubular member having a pair of interface clamps 102 and a pair of interface clamp receptacles 104 for mating with corresponding interface clamp receptacles 104 and interface clamps 102, according to the aforementioned interface clamp system 100. Such arrangement fixedly, yet releasably, couples A-arm assembly 120 to EADS platform 10. As can be seen in FIGS. 9–11, main support member 122 may be a single unitary member that spans generally across end 44 of EADS platform 10, or may be two separate members located only adjacent interface clamp systems 100. Each of the pair of support arms 124 preferably includes an I-beam shaped cross-section to resist bending forces, while lateral cross member 126 is preferably circular in cross-section to permit interface with the LHS of the transport vehicle. A unique feature of bail bar 126 allows it to articulate in such a manner as to alleviate unwanted downward forces being placed on A-arm assembly 120 by the load handling vehicle which could transmit undesirable loads to the cargo loader or aircraft roller systems. Bail bar 126 may optionally be pivotally coupled to support arms 124 via a hinge connection between bail bar 126 and support arms 124 and a locking stud (not shown) extending through bail bar 126 and support arms 124 to prevent unwanted relative rotation. This pivotal arrangement permits bail bar 126 to be folded downward to minimize the overall height of EADS platform 10, thereby permitting EADS platform 10 to be used in smaller cargo aircraft. Additionally, A-arm assembly 120 may be optionally pivotally coupled to EADS platform 10 to permit A-arm assembly 120 to be folded downward onto an upper empty surface of EADS platform 10 to simplify storage of EADS platform 10. To this end, support arms 124 may be hingedly coupled to main support members 122 and lockable in a lowered and/or raised position via locking studs.

Figure 15:
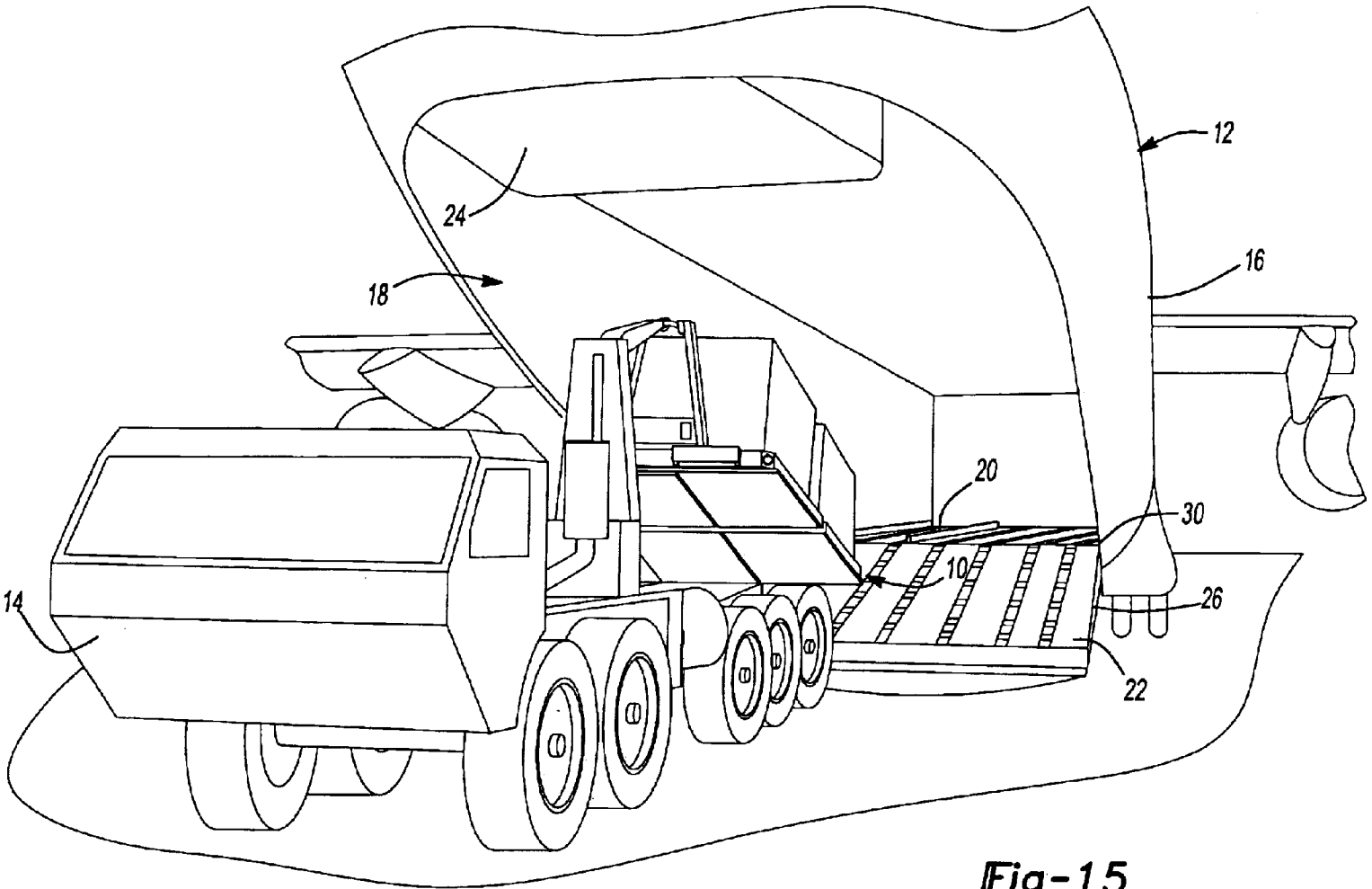
FIG. 15 is an environmental view illustrating the EADS platform according to the principles of the present invention being loaded on a cargo aircraft by a PLS equipped vehicle.

As seen in FIG. 15, during operation, the cargo handling system of the transport vehicle grasps lateral cross member 126 to lift and roll EADS platform 10 (and 10') onto the bed of the vehicle. Once into position near lower cargo door 26 or other transport vehicle, cargo-handling system of the transport vehicle releases EADS platform 10 (and 10') onto lower cargo door 26, according to known loading principles.

Figure 12:
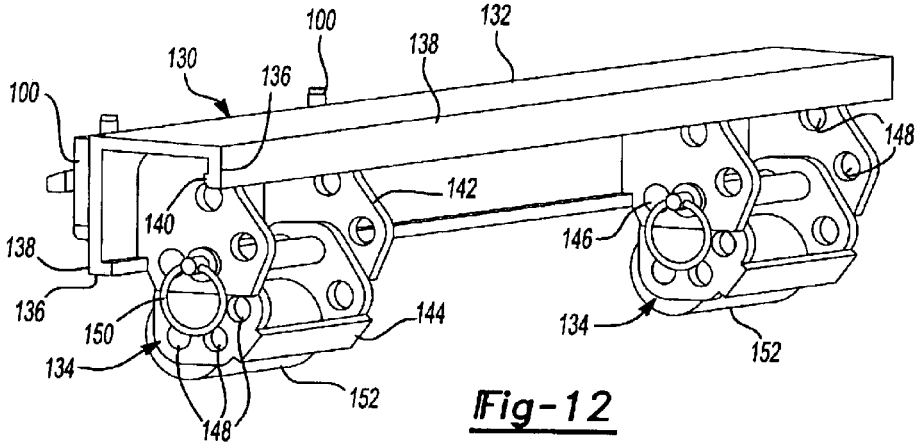
FIG. 12 is a perspective view illustrating a removable, adjustable wheel assembly according to the principles of the present invention in a lower and widened position.
Figure 13:
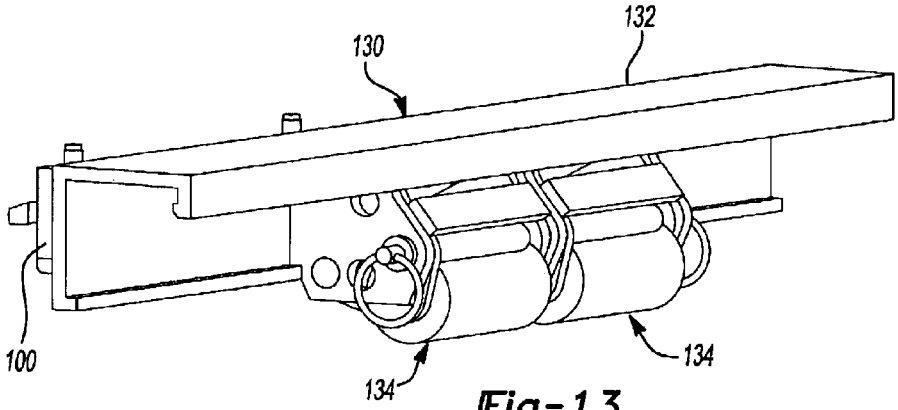
FIG. 13 is a perspective view illustrating the removable, adjustable wheel assembly according to the principles of the present invention in an intermediate and narrowed position.
Figure 14:
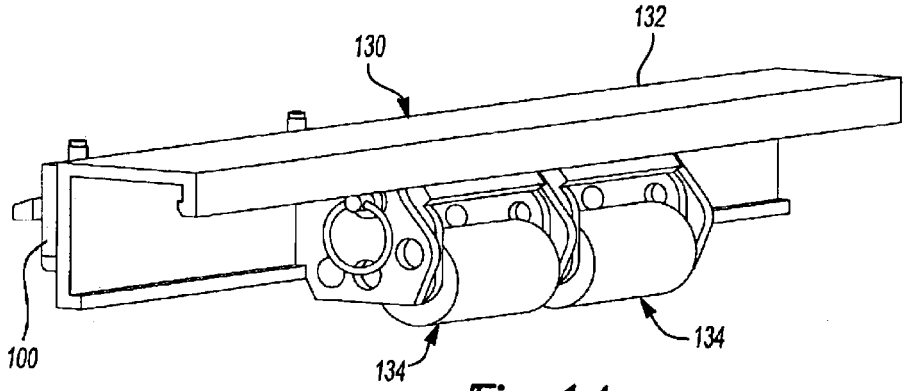
FIG. 14 is a perspective view illustrating the removable, adjustable wheel assembly according to the principles of the present invention in a raised and narrowed position.

Referring now to FIGS. 12–14, EADS platform 10 further includes removable, adjustable wheel assembly 130, which is releasably coupled to EADS platform 10 at an unmated end 44, which permits EADS platform 10 to roll into or out of a standard ISO container and across the deck of aircraft cargo ramp, K-loader floor, and/or PLS trailer. To this end, adjustable wheel assembly 130 includes a generally angular bracket member 132. Bracket member 132 includes a plurality of interface clamp systems 100 mounted thereto to selectively couple adjustable wheel assembly 130 to an unmated end 44 of EADS platform 10, according to the aforementioned principles. Adjustable wheel assembly 130 further includes preferably a pair of wheel roller assemblies 134 slidably coupled to bracket member 132. Specifically, bracket member 132 includes a pair of retaining flanges 136 that extend along edges 138 thereof. At least one of the pair of retaining flanges 136 includes a hook portion 140 that engages each of the pair of wheel roller assemblies 134 to maintain proper coupling of the pair of wheel roller assemblies 134 with bracket member 132. However, it should be appreciated that the pair of retaining flanges 136 and hook portion 140 permit each of the pair of wheel roller assemblies 134 to slide laterally relative to EADS platform 10. In other words, the pair of wheel roller assemblies 134 may be positioned in a generally wide-stance (see FIG. 12) for use in rolling across a PLS trailer or the pair of wheel roller assemblies 134 may be positioned in a generally narrow-stance (see FIGS. 13 and 14) for rolling on a floor or for storage.

Still referring to FIGS. 12–14, each of the pair of wheel roller assemblies 134 is adjustable to provide more or less roller contact with a floor. Specifically, each of the pair of wheel roller assemblies 134 includes a first support member 142 and a second support member 144. First support member 142 is generally U-shaped and slidably engages hook portion 140 and retaining flanges 136. Second support member 144 is generally U-shaped and is pivotally coupled to first support member 142 via a pivot pin 146. First support member 142 and second support member 144 each includes a plurality of adjustment holes 148. Second support member 144 rotatably supports a roller 152. An indexing or clevis pin 150 extends through corresponding adjustment holes 148 formed in first support member 142 and second support member 144 to adjust the extension and/or retraction position of roller 152 relative to lower surface 40 of EADS platform 10. In this regard, rollers 152 may be quickly and conveniently extended into one of a number of operating positions (FIGS. 12 and 13) or retracted into a stowed position (FIG. 14). Accordingly, EADS platform 10 to be directly loaded and unloaded by a LHS equipped vehicle directly to or from a C-17, K-loader, or ISO container without the use of material handling equipment or exceeding load bearing footprint capacity, since the load is evenly distributed across the face of several rollers 152. It should be understood that any number of rollers may be used to further distribute these loads.

The modular configuration of EADS platform 10 provides the ability to attach the necessary equipment, such as A-arm assembly 120, adjustable wheel assembly 130, or additional EADS platforms 10', for rapid reconfiguration of loads without unloading each EADS platform 10. Each EADS platform 10 is identical and, thus, can be easily mated with adjoining EADS platform 10 without the need for special mating platforms. Therefore, by joining and locking adjacent EADS platforms 10 and attaching A-arm assembly 120 and adjustable wheel assembly 130, the joined EADS platform 10 can be handled and transported like a full size CROP. However, the joined EADS platform 10 may also be separated into pallets and transport via forklift, aircraft, etc. without the need to tear down the loads.

EADS platform 10 is may be airdropped as an individual pallet using all 108" airdrop rail systems or as a joined EADS platform 10 using the 88" logistics rail system of the C-17. When dropped individually, features such as the plurality of heavy lift rings 82 and/or the plurality of retractable restraints 84 permit EADS platforms 10 to be drawn together on the ground to form the joined EADS platform 10, which may be easily removed by a LHS equipped vehicle. Without the use of Material Handling Equipment (MHE), any drop zone vehicle may use organic retractable restraint cables 84 attached to the plurality of heavy lift rings 82 to maneuver each EADS platform 10 in close proximity to another EADS platform 10 to permit latching of the platforms together.

According to the principles of the present invention, EADS platform 10 provides a single transportation platform capable of interfacing with standardized ISO containers, PLS truck-and-trailer systems, and cargo aircraft and HSV rail and pallet locking system. That is, EADS platform 10 provides a pallet interface system that eliminates the need for a married pallet system to be used in the process of loading and supporting CROP type loads being transported on a cargo aircraft. Furthermore, EADS platform 10 provides a system that can be positioned on the roller assembly of a loading ramp of a cargo aircraft, such as a C-17, that can be loaded onto or unloaded from the aircraft without the need for a large crane, and which permits combat offloads to be performed. Still further, EADS platform 10 provides a system that overcomes the disadvantages of the prior art.

It will be appreciated that a principal advantage of the present invention is that no crane is required to first place EADS platform 10 on a married pallet system and a K-loader used to place the entire assembly on the loading ramp of the aircraft. This also allows cargo to be off loaded at airfields where a large crane is not available for removing the cargo-supporting platform from its pallet system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft;

a plurality of forklift slots formed generally parallel to at least one of said upper surface and said lower surface, said plurality of forklift slots being sized to receive forks of a forklift for lifting the pallet system; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

2. The pallet system according to claim 1, further comprising:

a plurality of lifting rings generally mounted to said first cargo pallet, said plurality of lifting rings being connectable to a lifting device for lifting the pallet system.

3. The pallet system according to claim 1, further comprising:

a plurality of interface clamp systems removably coupled to at least one of said intermediate side surfaces, said plurality of interface clamp systems being connectable to a second cargo pallet.

4. The pallet system according to claim 1, further comprising:

an arm assembly removably coupled to said first cargo pallet, said arm assembly being sized to receive a Palletize Loading System (PLS) lifting arm.

5. The pallet system according to claim 1, further comprising:

a plurality of tie down rings retractably disposed along said upper surface of said first cargo pallet, said plurality of tie down rings operable to tether cargo upon said first cargo pallet, said plurality of tie down rings being positionable in an extended position generally non-coplanar with said upper surface and a retract position generally co-planar with said upper surface.

6. The pallet system according to claim 1, further comprising:

a pallet rail retractably mounted to said first cargo pallet, said pallet rail operable to retain cargo upon said first cargo pallet, said pallet rail being positionable in an extended position generally non-coplanar with said upper surface and a retract position generally co-planar with said upper surface.

7. The pallet system according to claim 1, further comprising:

a retractable restraint coupled to said first cargo pallet, said retractable restraint having a hook member tethered to said first cargo pallet via a line, said line being biased so as to retracted said hook member.

8. The pallet system according to claim 1, further comprising:

a roller track disposed within slots formed in said upper surface of said first cargo pallet, said roller tracks having rollers disposed along one side thereof such that said roller tracks may be positioned in a first position where said rollers extend above said upper surface and a second position where said rollers are retracted below said upper surface.

9. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft;

a plurality of lifting rings generally mounted to said first cargo pallet, said plurality of lifting rings being connectable to a lifting device for lifting the pallet system; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

10. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft; and a plurality of interface clamp systems removably coupled to at least one of said intermediate side surfaces, said plurality of interface clamp systems being connectable to a second cargo pallet; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

11. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft;

an arm assembly removably coupled to said first cargo pallet, said arm assembly being sized to receive a Palletize Loading System (PLS) lifting arm; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

12. The pallet system according to claim 11 wherein said arm assembly comprises:

a main support member;

a pair of support arms fixedly coupled and upwardly extending from said main support member; and a cross member fixedly coupled between said pair of support arms, said main support member, said pair of support arms, and said cross member being arranged general in an A-shape.

13. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft; and a plurality of tie down rings retractably disposed along said upper surface of said first cargo pallet, said plurality of tie down rings operable to tether cargo upon said first cargo pallet, said plurality of tie down rings being positionable in an extended position generally non-coplanar with said upper surface and a retract position generally co-planar with said upper surface; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

14. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

15. The pallet system according to claim 14 wherein said wheel assembly comprises:

a bracket member;

an interface clamp system coupled to said bracket member, said interface clamp system being connectable to said first cargo pallet; and a pair of wheel roller assemblies moveably coupled to said bracket member, said pair of wheel roller assemblies being laterally moveable from a central position relative to said bracket member to an outboard position relative to said bracket member.

16. The pallet system according to claim 15 wherein said interface clamp system comprises:

an interface clamp coupled to one of said first cargo pallet and said bracket member,said interface clamp having an outwardly-directed moveable jaw portion; and an interface clamp receptacle coupled to one of said first cargo pallet and said bracket member, said interface clamp receptacle having an aperture for receiving said outwardly-directed moveable jaw portion to define a rigid connection between said first cargo pallet and said bracket member.

17. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft; and a pallet rail retractably mounted to said first cargo pallet, said pallet rail operable to retain cargo upon said first cargo pallet, said pallet rail being positionable in an extended position generally non-coplanar with said upper surface and a retract position generally co-planar with said upper surface; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

18. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft;

a retractable restraint coupled to said first cargo pallet, said retractable restraint having a hook member tethered to said first cargo pallet via a line, said line being biased so as to retracted said hook member; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

19. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar;

a plurality of retaining flanges disposed about said lower surface, said plurality of retaining flanges being operable to engage a rail system of a cargo aircraft;

a roller track disposed within slots formed in said upper surface of said first cargo pallet, said roller tracks having rollers disposed along one side thereof such that said roller tracks may be positioned in a first position where said rollers extend above said upper surface and a second position where said rollers are retracted below said upper surface; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

20. A pallet system for loading and supporting cargo, said pallet system comprising:

a first cargo pallet having an upper surface, a lower surface, and intermediate side surfaces generally interconnecting said upper surface and said lower surface, each of said upper surface and said lower surface being substantially planar; and a wheel assembly removably coupled to said first cargo pallet, said wheel assembly having a wheel adjustably coupled within a housing, said wheel being positionable in an extended position adapted for use with a Palletize Loading System (PLS), an intermediate position adapted for use to permit rolling of said first cargo pallet along a floor surface, and a retracted position adapted for use in a container.

21. The pallet system according to claim 20, further comprising:

a plurality of retaining flanges disposed about said lower surface, said plurality of retaining flanges being operable to engage a rail system of a cargo aircraft.

22. The pallet system according to claim 20, further comprising:

a plurality of forklift slots formed generally parallel to at least one of said upper surface and said lower surface, said plurality of forklift slots being sized to receive forks of a forklift for lifting the pallet system.

23. The pallet system according to claim 20, further comprising:

a plurality of lifting rings generally mounted to said first cargo pallet, said plurality of lifting rings being connectable to a lifting device for lifting the pallet system.

24. The pallet system according to claim 20, further comprising:

a plurality of interface clamp systems removably coupled to at least one of said intermediate side surfaces, said plurality of interface clamp systems being connectable to a second cargo pallet.

25. The pallet system according to claim 20, further comprising:

an arm assembly removably coupled to said first cargo pallet, said arm assembly being sized to receive a Palletize Loading System (PLS) lifting arm.

26. The pallet system according to claim 20, further comprising:

a plurality of tie down rings retractably disposed along said upper surface of said first cargo pallet, said plurality of tie down rings operable to tether cargo upon said first cargo pallet, said plurality of tie down rings being positionable in an extended position generally non-coplanar with said upper surface and a retract position generally co-planar with said upper surface.

27. The pallet system according to claim 20, further comprising:

a pallet rail retractably mounted to said first cargo pallet, said pallet rail operable to retain cargo upon said first cargo pallet, said pallet rail being positionable in an extended position generally non-coplanar with said upper surface and a retract position generally co-planar with said upper surface.

28. The pallet system according to claim 20, further comprising:

a retractable restraint coupled to said first cargo pallet, said retractable restraint having a hook member tethered to said first cargo pallet via a line, said line being biased so as to retracted said hook member.

29. The pallet system according to claim 20, further comprising:

a roller track disposed within slots formed in said upper surface of said first cargo pallet, said roller tracks having rollers disposed along one side thereof such that said roller tracks may be positioned in a first position where said rollers extend above said upper surface and a second position where said rollers are retracted below said upper surface.

* * * * *